US010646024B2

(12) United States Patent
Snoddy

(10) Patent No.: US 10,646,024 B2
(45) Date of Patent: May 12, 2020

(54) JAMMOCK

(71) Applicant: James Richard Snoddy, Alexandria, VA (US)

(72) Inventor: James Richard Snoddy, Alexandria, VA (US)

(73) Assignee: James Richard Snoddy, Arlington, VA (US)

( * ) Notice: Subject to any disclaimer, the term of this patent is extended or adjusted under 35 U.S.C. 154(b) by 0 days.

(21) Appl. No.: 13/886,230

(22) Filed: May 3, 2013

(65) Prior Publication Data

US 2013/0298327 A1 Nov. 14, 2013

Related U.S. Application Data

(60) Provisional application No. 61/646,092, filed on May 11, 2012.

(51) Int. Cl.
*A45F 3/24* (2006.01)

(52) U.S. Cl.
CPC ..... *A45F 3/24* (2013.01)

(58) Field of Classification Search
CPC ..... A45F 3/24
USPC .... 5/118, 119, 120, 122, 127; 296/102, 210, 296/211
See application file for complete search history.

(56) References Cited

U.S. PATENT DOCUMENTS 402,180 A * 4/1889 Murdock ..... 5/83.1
1,204,416 A * 11/1916 Doser ..... 5/94
2,348,217 A * 5/1944 Jones ..... 5/118
2,467,890 A * 4/1949 Harvey ..... 5/122
4,221,424 A * 9/1980 Eiserman et al. ..... 296/152
4,739,528 A * 4/1988 Allen ..... 5/119
4,807,314 A * 2/1989 Fry et al. ..... 5/118
5,170,521 A * 12/1992 Light ..... 5/118
5,708,994 A * 1/1998 Chandran ..... 5/102
D474,145 S * 5/2003 Dawson et al. ..... D12/401
6,701,549 B1 * 3/2004 Eriksen ..... 5/120
6,851,739 B2 * 2/2005 Morley ..... 296/102
7,020,915 B1 * 4/2006 Helsdon ..... 5/121
7,025,404 B1 * 4/2006 Gilbert ..... 296/102
7,213,866 B2 * 5/2007 Metts et al. ..... 296/102
7,225,484 B1 * 6/2007 Ortiz ..... 5/424
7,828,364 B2 * 11/2010 Causey ..... 296/136.12
8,316,482 B1 * 11/2012 Martin, III ..... 5/95
(Continued)

OTHER PUBLICATIONS http://web.archive.org/web/20101010103630/http://www.tothewoods.net/HomemadeGearJeepHammock.html "Just Jeff's Hiking Page", Oct. 10, 2010.*

*Primary Examiner* — Eric J Kurilla
(74) *Attorney, Agent, or Firm* — Usha Koshy

(57) ABSTRACT

A heavy-duty, load bearing, partially sun-screening, water-resistant, SUV soft-top for perpendicular suspension between the roll bars on the rooftop frame over the front passenger compartment of a convertible SUV comprising, a rectangular panel with longitudinal flat-hemmed sleeve edges and a pair of longitudinal webbings for fastening around the roll bars by means of fasteners. When human weight is applied on the soft-top panel, it flexes down and both the longitudinal webbings rise up to provide armrests stabilizers for the user. The webbings are tightened with tension buckles. The Jammock soft-top is installed on the roof top of a convertible SUV after removal of the existing hard, or soft-top.

4 Claims, 3 Drawing Sheets

(56) References Cited

U.S. PATENT DOCUMENTS

| | | | | |
|---|---|---|---|---|
| 8,424,138 | B1 * | 4/2013 | Pinnell | 5/655 |
| 8,622,457 | B1 * | 1/2014 | McIntire | 296/102 |
| 2002/0042951 | A1 * | 4/2002 | Hennessy | 5/120 |
| 2005/0001446 | A1 * | 1/2005 | Morley | 296/102 |
| 2006/0213010 | A1 * | 9/2006 | Davis | 5/626 |
| 2007/0018485 | A1 * | 1/2007 | Jacobson | 296/210 |
| 2009/0205131 | A1 * | 8/2009 | Bishop | 5/118 |
| 2010/0242173 | A1 * | 9/2010 | Landry | 5/494 |

* cited by examiner

JAMMOCK

CROSS REFERENCE TO RELATED APPLICATION

This application claims priority to Provisional Patent Application reference No. 61/646,092 filed May 11, 2012 which is incorporated herein, in its entirety.

FIELD OF THE INVENTION

This invention relates in general to soft-tops for Sports Utility Vehicles (SUV) More particularly, the invention relates to an SUV soft-top that can be used as a bedding to rest and/or sleep on when the vehicle is stationary.

BACKGROUND OF THE INVENTION

Conventional soft-tops for SUV's possess several desirable features for the SUV enthusiast. They are generally made of a water proof non-flappable material to provide protection from the elements and sunlight and a quiet ride. However, conventional soft-tops have a variety of undesirable features that have limited their widespread use by convertible SUV enthusiasts. Load bearing ability, ease of installation, and stability are key drawbacks of the conventional SUV soft-tops.

The compromise needed to make a non-flapping element-protecting soft-top for an SUV has always been that the non-load bearing soft-top's frame must maintain a delicate balance of tension on the material, thereby making it unsuitable for bearing significant loads. Normal SUV soft-tops, in their quest for a quiet ride and protection from the elements, must compromise with hard to install/uninstall frames or multiple straps that require time and tools for the install/uninstall process. This renders all current soft-tops unsuitable for bearing significant loads. Further, these conventional soft-tops are tensioned such that they do not flex enough to be comfortable when a load is applied as for instance when a person is sitting, or lying on top of the soft-top. Anyone who has used his SUV soft-top as a load bearing one has regretted it due to the resulting catastrophic damage to the soft top, the increased noise from violating the delicate tension required for such a soft-top, and the added risk of injury to the person who reclines on the soft-top. In addition to the potential danger associated with setting significant loads on top of a conventional SUV soft-top, is the problem of stability.

There is a need in the convertible SUV industry for a load bearing, heavy-duty, easy to install and uninstall, SUV soft-top that is of stable construction for reclining, and one which can be suspended on the roof top of an unmodified convertible SUV using the roll bars on the roof top frame of the SUV. The primary objective of this invention is to meet this need. The load bearing soft-top's ease of installation renders this invention one of the quickest and easiest to install, and uninstall, on the market.

SUMMARY OF THE INVENTION

The primary object of the present invention is to provide an easily and quickly installable human slumber seat on the roof top of an unmodified, stationary, convertible SUV, that is comfortable, safe, and stable.

Secondary objectives are:

1) To provide a heavy-duty soft-top that remains installed and unobtrusive to the occupants of the SUV while not in use.
2) To provide some shade that shields occupants of the SUV from the sun.
3) To provide at least minimal protection from the rain.
4) To provide a semi-permeable soft-top that allows ventilation.
5) To provide an alternate load bearing capability outside of the SUV as needed.

The present invention is a heavy-duty, easily and quickly installable load bearing, SUV soft-top, with weight activated armrests/stabilizers for perpendicular suspension between two parallel poles, the SUV roll bars on the roof top frame of a convertible SUV. The soft-top of the invention is comprised of a rectangular panel having a width and length sized to cover the open area above the front passenger compartment on the roof top of a convertible SUV to support a reclined user. The panel of the soft-top has longitudinal side edges and lateral end edges parallel to the roll bars. A pair of longitudinal flat-hemmed sleeves are secured to the longitudinal side edges of the panel. The soft-top is further comprised of a pair of elongate webbings having greater width than thickness, and having an effective length for securement to the SUV roll bars through fasteners to support the soft-top panel between the SUV roll bars as the soft-top panel is suspended between the roll bars in the open area over the passenger compartment on the roof top of a convertible SUV. Each webbing has a fastener coupled to one end of the webbing adapted for coupling to a second fastener at the other end of the same webbing after the webbing is placed over and encircled over a roll bar of the SUV to hold the soft-top panel in place between the roll bars. Applying the weight of a normal human to the panel will activate each of the webbings resulting in both webbings becoming armrest stabilizers.

The weight-activated armrest stabilizers and flex of the soft-top panel of the Jammock device guarantees a secure reclining seat for a user while the convertible SUV is stationery. The load bearing soft-top is not intended for human load bearing use while the convertible SUV is moving. The load bearing soft-top is intended to be unobtrusive to the SUV passengers while not in use for most drivers under seven feet tall due to the semi-rigid nature of the panel material and the tension of the-webbing. The load bearing soft-top's ease of installation renders this soft-top one of the quickest and easiest to install or uninstall in the market.

BRIEF DESCRIPTION OF THE DRAWINGS

In the following description of the drawings, like reference numerals are employed to indicate like parts in the various views.

DETAILED DESCRIPTION OF THE INVENTION

The present invention is a heavy-duty, load bearing soft-top for convertible SUV enthusiasts. The soft-top of the present invention can be securely fastened between two to four anchor points such as the SUV roll bars. The soft-top panel of the invention is made from a tightly woven, semi-rigid, water-resistant fabric that is semi-permeable to rain and provides the occupants of the vehicle, shade from the sun.

Figure 1:
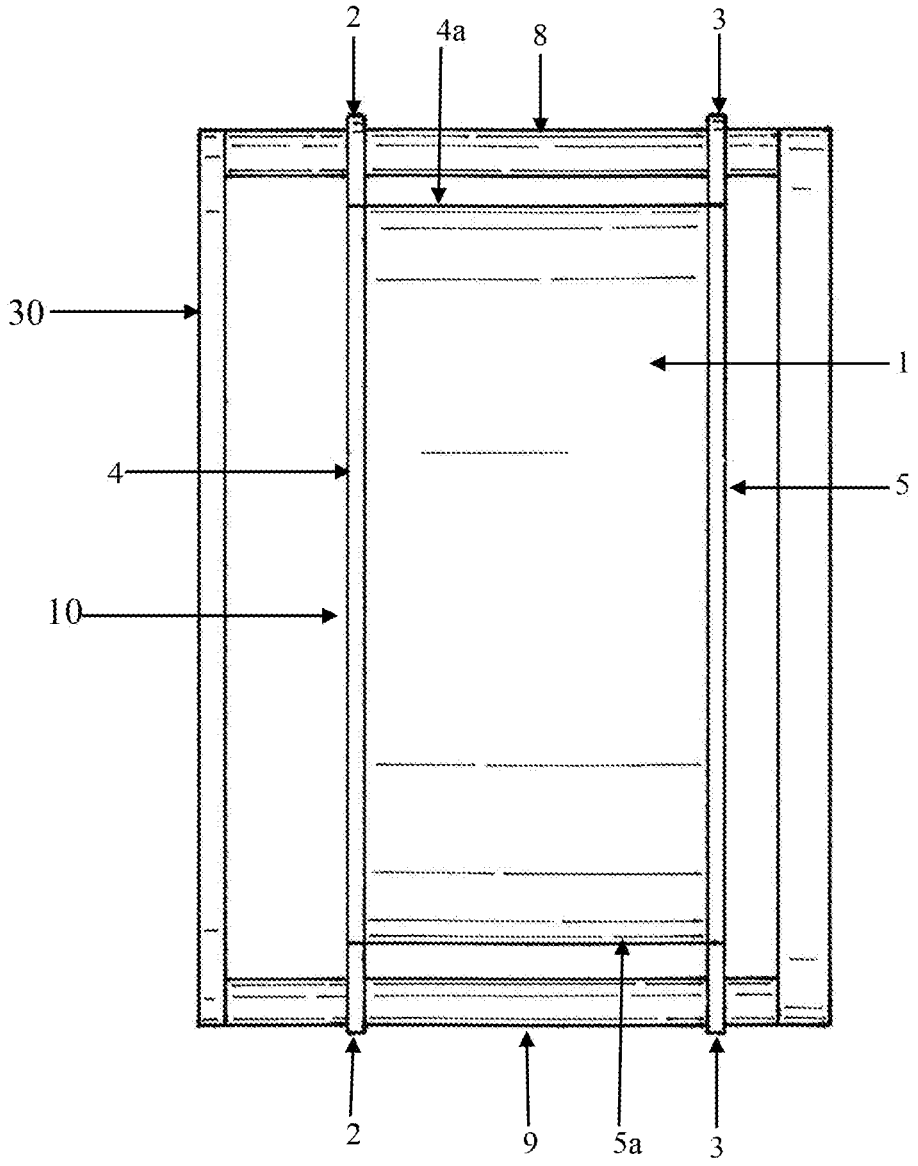
FIG. 1 is a top plan view of the soft-top Jammock constructed in accordance with a first preferred embodiment of the invention shown suspended between roll bars on the rooftop frame of a convertible SUV.

Referring now to the drawings in greater detail, attention is first directed to FIG. 1 which illustrates a first preferred embodiment of the soft-top Jammock 10 of the invention suspended between the roll bars 8 and 9 on the rooftop flame of a convertible SUV. The soft-top panel 1 has longitudinal flat-hemmed sleeve side edges 4 and 5 and lateral end edges 4*a* and 5*a*. A pair of spaced apart webbings 2 and 3 are placed around the roll bars 8 and 9 by means of fasteners (not seen in this view) to secure the soft-top 10 to cover the open area above the passenger compartment on the rooftop of a convertible SUV 30. FIG. 1 illustrates the soft-top Jammock 10 at rest, with the weight-activated armrest stabilizers comprising the webbings 2 and 3 inactive and hidden below the semi-rigid fabric panel 1 and with the flat-hemmed sleeve edges 4 and 5 and the lateral end edges 4*a* and 5*a* in view.

Figure 2:
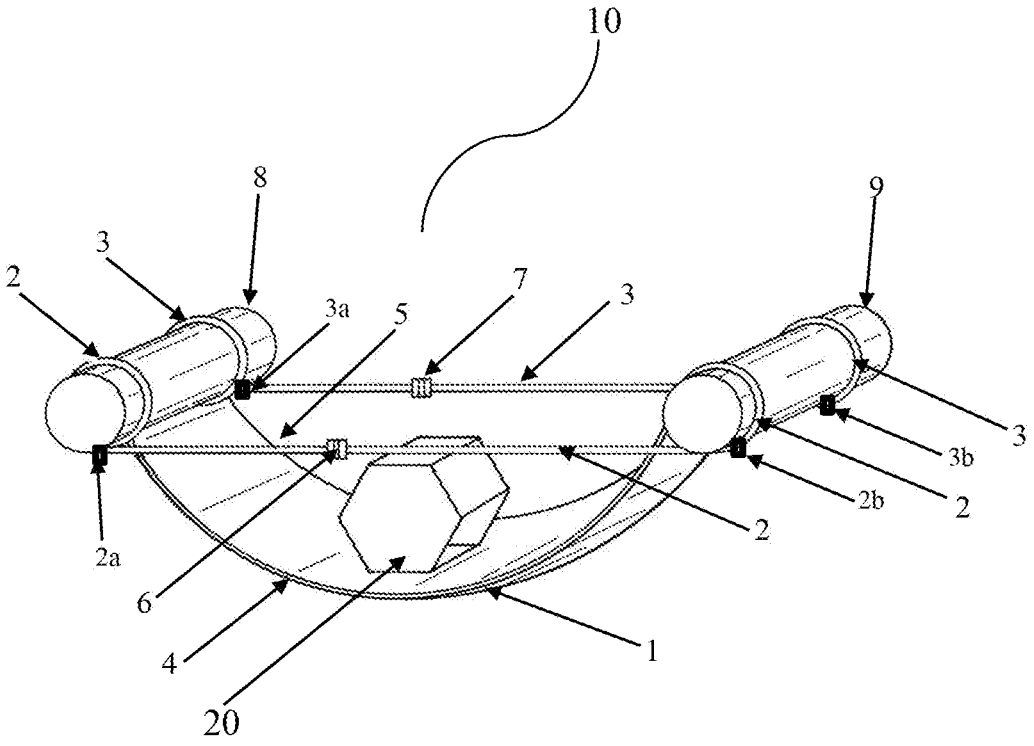
FIG. 2 is a perspective view of the soft-top Jammock as it bears weight to show the activation of the webbing armrest stabilizers.
Figure 3:
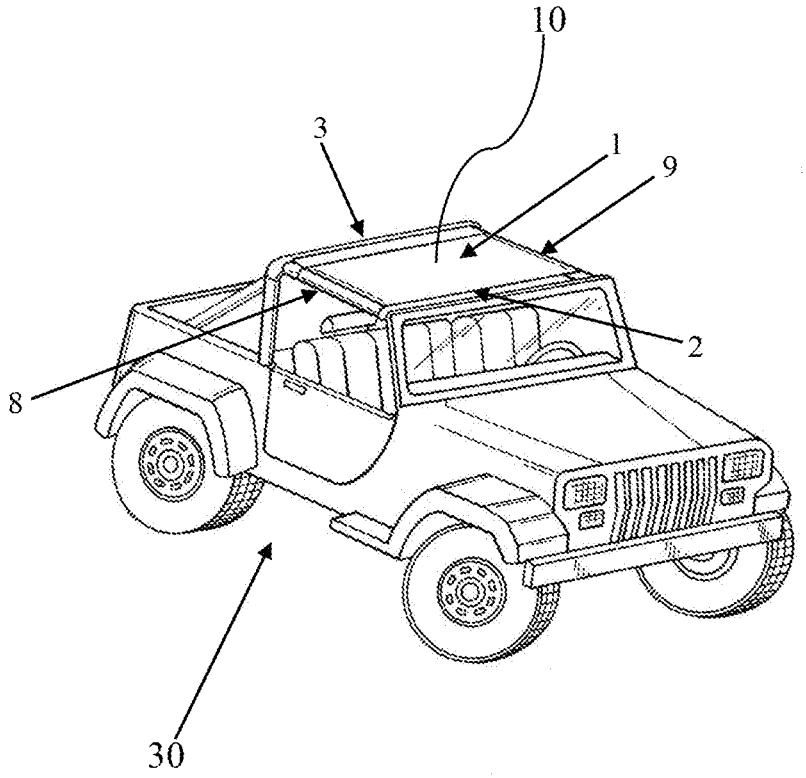
FIG. 3 is a perspective view of the soft-top Jammock of the invention installed on the roof top of a convertible SUV.

The construction of the soft-top Jammock 10 can be best understood with reference to FIG. 2. The soft-top Jammock 10 includes a generally rectangular, semi-rigid fabric panel 1 having a width and a length appropriately sized to accommodate the opening between the roll bars 8 and 9 on the roof top over the front passenger compartment of a convertible SUV. The semi-rigid fabric panel 1 has longitudinal flat-hemmed sleeve edges 4 and 5 which extend along the length of the semi-rigid fabric panel 1 and lateral end edges (not visible in this view) parallel to said roll bars 8 and 9. Extending along the length of these longitudinal flat-hemmed sleeve edges 4 and 5 are webbings 2 and 3 that act as anchor points for the soft-top Jammock 10. Each webbing is held on the roll bars by means of a pair of fasteners. Webbing 2 is fastened to roll bar 8 with fastener 2*a* and fastened to roll bar 9 with fastener 2*b*. Webbing 3 is fastened to roll bar 8 with fastener 3*a* and fastened to roll bar 9 with fastener 3*b*. When weight 20 is applied to the semi-rigid fabric panel 1 such as when a body reclines on the panel 1, the panel flexes downward and the webbings 2 and 3 flex upwards, above the front and rear flat-hemmed sleeve edges 4 and 5, to provide the armrest stabilizers. The tension buckle 6 on webbing 2 and tension buckle 7 on webbing 3 are used to tighten the respective webbings.

In terms of materials of construction, the semi-rigid fabric panel 1 and the flat-hemmed sleeve edges 4 & 5 of the Jammock 10 are fabricated from a tightly woven, flexible fabric. For example, the material used as the platform for trampolines is strong and durable for this application, in addition to offering shade and water-resistant properties. The webbings 2 and 3 may be nylon belting material of at least 1 inch width fitted with metal tension buckles 6 and 7 (double bar slides) preferably made of heavy-duty steel, or other heavy duty metal.

In operation, the user simply removes the Jammock 10 from storage and places the semi-rigid fabric panel 1 and the front and rear webbing 2 and 3 in the open area over the front passenger compartment on the rooftop of a convertible SUV. The ends of the front and rear webbings 2 and 3 are placed over the roll bars 8 and 9 of the convertible SUV and held in place over the roll bars 8 and 9 by means of the fasteners to secure the panel 1 of the soft top 10 over the passenger compartment on the roof top of the convertible SUV. Both webbings 2 and 3 are tightened via the tension buckles 6 and 7. When weight 20 is applied to the top of the semi-rigid fabric panel 1 the semi-rigid fabric panel 1 flexes down. In so doing, the webbings 2 and 3 are tightened more and flex up and over the front and rear flat-hemmed sleeve edges 4 and 5 of the panel 1 to create the armrest stabilizers.

From the foregoing description of the exemplary parts and manner of use of the Jammock 10, it will be understood that this invention is one that is well adapted to attain all the ends and objects set forth in the summary and detailed description of the invention, together with the other advantages which are obvious and inherent in the invention. It is to be understood that certain features and sub-combinations described herein are of utility and may be employed without reference to other features and sub-combinations and are contemplated within the scope of the enumerated claims.

It is to be further understood that the embodiments of the present invention as described herein do not limit any application or scope of the invention and that the invention can be carried out and practiced in various ways and implemented in embodiments other than the ones outlined in the description above. It should be understood and obvious to one skilled in the art that alternatives, modifications, and variations of the embodiments of the present invention may be construed as being within the spirit and scope of the appended claims.

Having thus described my invention, I claim:

1. A heavy-duty, load bearing, convertible Sports Utility Vehicle (SUV) soft-top with weight activated armrest stabilizers for perpendicular suspension between a first and a second roll bar on a roof top frame of said SUV, said soft-top comprising:

a rectangular panel structure having a width and a length sized to cover an opening between said roll bars on said roof top frame of said SUV;

said rectangular panel having a first longitudinal side flat-hemmed sleeve edge and a second longitudinal side flat-hemmed sleeve edge;

said rectangular panel having a first lateral end edge-edge and a second lateral end edge parallel to said first and second roll bars;

a first webbing extending along a length of said first longitudinal side flat-hemmed sleeve edge of said rectangular panel and a second webbing extending along a length of said second longitudinal side flat-hemmed sleeve edge of said rectangular panel with each of said webbings having an effective length to encircle said roll bars to hold said rectangular panel between said roll bars;

said first webbing and said second webbing having greater width than thickness;

a first fastener coupled to a first end of said first webbing to secure said first webbing to said first roll bar and a second fastener coupled to a second end of said first webbing to secure said first webbing to said second roll bar;

a third fastener coupled to a first end of said second webbing to secure said second webbing to said first roll bar and a fourth fastener coupled to a second end of said second webbing to secure said second webbing to said second roll bar;

a first tension buckle coupled to said first webbing and a second tension buckle coupled to said second webbing; and said rectangular panel structure of said soft too supporting a weight of a reclined user of said soft top on said roof top frame of said SUV.

2. The soft-top as in claim 1 wherein the tension buckles are used to adjust the length of the webbings to provide the necessary tension to suspend the soft-top rectangular panel structure between the roll bars of the SUV on the roof top frame of the SUV.

3. The soft-top as in claim 1 wherein the webbings are tightened using the tension buckles to allow for self-activation of the webbings to form armrest stabilizers when the weight of a reclining user is applied to the rectangular panel structure of the soft-top.

4. The soft-top as in claim 3 wherein when weight is applied to the panel structure, it flexes downwards and the webbings flex upward and over the flat-hemmed sleeve edges of the panel structure to create said armrest stabilizers.

* * * * *